US010668518B2

(12) United States Patent
Bertini et al.

(10) Patent No.: US 10,668,518 B2
(45) Date of Patent: Jun. 2, 2020

(54) MACHINE FOR FORMING AND PROFILING A METAL TUBULAR PRODUCT, LIKE A PIPE

(71) Applicant: Bertini Macchine S.R.L., Carugo (CO) (IT)

(72) Inventors: Gianni Bertini, Carugo (IT); Emilio Bertini, Carugo (IT); Modesto Bertini, Carugo (IT)

(73) Assignee: BERTINI MACCHINE S.R.L., Carugo (CO) (IT)

( * ) Notice: Subject to any disclaimer, the term of this patent is extended or adjusted under 35 U.S.C. 154(b) by 372 days.

(21) Appl. No.: 15/475,531

(22) Filed: Mar. 31, 2017

(65) Prior Publication Data

US 2017/0282233 A1 Oct. 5, 2017

(30) Foreign Application Priority Data

Apr. 1, 2016 (IT) ..... 102016000033912

(51) Int. Cl.
*B21D 26/033* (2011.01)
*B21D 26/045* (2011.01)
*B21D 15/10* (2006.01)

(52) U.S. Cl.
CPC ..... *B21D 26/033* (2013.01); *B21D 15/10* (2013.01); *B21D 26/045* (2013.01)

(58) Field of Classification Search
CPC ..... B21D 26/033; B21D 15/03; B21D 15/10; B21D 26/039; B21D 26/041–045; B21D 26/047; B21D 26/025; B21D 26/043; B21D 37/04
USPC ..... 72/58, 59, 61
See application file for complete search history.

(56) References Cited

U.S. PATENT DOCUMENTS 2,770,874 A * 11/1956 Lindow ..... B21D 26/033 29/421.1
4,513,598 A * 4/1985 Costabile ..... B21D 26/043 29/421.1
4,619,129 A * 10/1986 Petkov ..... B21D 15/06 29/421.2
4,751,836 A * 6/1988 Breese ..... B21D 26/045 29/421.1
4,761,982 A * 8/1988 Snyder ..... B21D 26/043 264/573
5,233,854 A * 8/1993 Bowman ..... B21D 26/039 29/421.1
5,735,156 A * 4/1998 Yoshitomi ..... B21D 15/00 29/421.1

(Continued)

FOREIGN PATENT DOCUMENTS

JP 2006122943 A * 5/2006

OTHER PUBLICATIONS

Battery—Google Definition Mar. 24, 2019 (Year: 2019).*
Specular—Google Definition Mar. 24, 2019 (Year: 2019).*
Joint—Google Definition Mar. 24, 2019 (Year: 2019).*

*Primary Examiner* — Edward T Tolan
(74) *Attorney, Agent, or Firm* — Greer Burns & Crain, Ltd.

(57) ABSTRACT

A machine for forming, using a pressurized fluid, and for profiling, using profiling tools, a metal tubular product, for instance a pipe, in one and the same work cycle. In particular a machine for forming a tubular product in two different portions thereof by using one injector only and forming the tubular product in two different non-adjacent portions by using two injectors.

5 Claims, 4 Drawing Sheets

(56) References Cited

U.S. PATENT DOCUMENTS

| | | | | |
|---|---|---|---|---|
| 5,737,952 | A * | 4/1998 | Baumann | B21D 26/045 72/325 |
| 6,014,879 | A * | 1/2000 | Jaekel | B21D 26/041 72/61 |
| 6,502,822 | B1 * | 1/2003 | Brown | B21D 26/045 277/314 |
| 8,910,500 | B2 * | 12/2014 | Baradari | B21D 26/043 29/421.1 |
| 2007/0166428 | A1 * | 7/2007 | Augustin | B21D 26/043 425/567 |
| 2009/0229102 | A1 * | 9/2009 | Kobayashi | B21D 26/041 29/421.1 |
| 2010/0072678 | A1 * | 3/2010 | Augustin | B21D 26/033 264/526 |
| 2011/0097596 | A1 * | 4/2011 | Mizumura | B21D 26/043 428/603 |
| 2012/0047979 | A1 * | 3/2012 | Hertell | B21D 26/033 72/58 |
| 2016/0175912 | A1 * | 6/2016 | Priem | B21D 26/06 72/56 |
| 2018/0015520 | A1 * | 1/2018 | Saika | B21D 26/047 |
| 2018/0221933 | A1 * | 8/2018 | Saika | B21D 26/033 |

* cited by examiner

MACHINE FOR FORMING AND PROFILING A METAL TUBULAR PRODUCT, LIKE A PIPE

OBJECT OF THE INVENTION

The object of the present invention is a machine for forming, by means of pressurized fluids, and for profiling, by means of profiling tools, a metal tubular product, for instance a pipe, in one work cycle. Another object of said machine is to form in the same production cycle a metal tubular product, for instance a pipe, in two different non-adjacent portions by using two injectors, as well as to form said tubular product in two adjacent portion by using one injector

Present Status of the Art

Machines are known for profiling metal tubular products, for instance a pipe, here below shortly referred to as "pipe", to perform rolling, tapering, flaring, molding, calibration, and/or other similar operations.

Machines are also known for forming pipes capable of performing one or several expansions of the pipe wall, which operation is called forming, by using high or very high pressure fluids. Such machines are capable of performing an expansion of the pipe wall in one portion only thereof.

A drawback of the known machines is thus in that they are capable of either profiling or forming a pipe. Also, they are not capable of forming a pipe, by creating expansions of the surface, in two different portions of a pipe in one forming cycle only. Such drawbacks oblige the companies to buy two different machines, i.e. one for forming and one for profiling, which means occupying space and charging workers with the task of handling pipes from the forming machines to the profiling one. Another drawback is in that the forming operation shall be repeated should it be necessary to perform such operations in different non-continuous portions of a pipe.

DISCLOSURE OF THE INVENTION

The drawbacks of the known machines are solved by a machine according to the present invention The present invention provides a machine equipped with a pusher suitable for pushing the pipe to be machined to a position suitable for being clamped by a vise. In the external portion(s) destined to form said pipe, there are placed one or several female molds suitable for determining the form(s) desired for such pipe following the expansion thereof thanks to the high or very high pressure that the inner wall of the pipe is submitted to. Such pressure is obtained by means of an injector introduced inside the pipe. Such injector, fed with a pressurized liquid via a fluid-dynamics control unit, is provided with at least one radial channel which allows to retain the high or very high pressure liquid in the desired zone so as to deform the inner wall of the pipe. Such inner wall, by adhering to the mentioned mold(s), gets the desired profile.

The injector is provided with one retractable gasket, another feature of which is in that it is self-centering during the expansion step, i.e. before the high or very high pressure liquid goes out. Such feature of the gasket makes it possible and in a very advantageous manner the adhesion of the gasket to the inner wall of the pipe, thus increasing the effectiveness of the injector.

The present invention provides an injector having two radial channels which make it possible to retain the high or very high pressure liquid in the desired zone in order to deform the inner wall of the pipe. Said injector is also equipped with two gaskets having the above illustrated features, i.e. those of being retractable and self-centering during the expansion step. Such injector makes it possible to perform a pipe forming in continuous portions thereof in one and the same work cycle. Such pipe forming is obtained in known machines by using two conventional injectors. An injector with two gaskets according to the present invention is thus capable of reducing the number of the work cycles.

The known machines make it possible to form one end only of a pipe during one work cycle. A machine according to the present invention makes it possible to form both ends of a pipe in one and the same work cycle. It includes a second injector in a position specular with respect to the first injector. In this way, said second injector can form the other end of the pipe in a similar way as that illustrated in the previous paragraphs in one and the same work cycle. Said second injector can also be provided with one radial channel only and one gasket only or with two radial channels and two gaskets, thus increasing the flexibility and the forming capabilities of a machine according to the present invention. The combinations of the injectors used of a machine according to the present invention are numerous. Such machine can have one injector with one gasket and the other injector with two gaskets or two injectors with two gaskets.

The two injectors with two gaskets each can operate at different pressures because the fluid-dynamics control unit is equipped with means suitable for simultaneously feeding each injector with fluids at different pressures. In other words, the mentioned control unit can feed, for instance, the first injector with a fluid at 1200 Bars and simultaneously feed the second injector with a fluid at 400 Bars. The mentioned control unit is thus suitable for feeding the injectors with two gaskets with fluids at different pressures, which means apparent advantages in productivity. Two different formings of a tubular product can be made with one injector by using that injector only.

The machine according to the present invention is also capable of profiling a pipe formed during one and the same work cycle. In order to advantageously achieve such result, a battery of profiling tools is placed next to at least one of the two injectors. When pipe forming is over, the injector moves back, goes out of the pipe, and moves along the X axis or along the Z axis, thus leaving space for the operation of the profiling tool specified by the work cycle. Remember that such tools can be tools to perform rolling, tapering, flaring, molding, calibration, and/or other similar operations.

DESCRIPTION OF THE FIGURES

FIG. 1 shows a machine assembly (1) for forming and profiling a is metal tubular product, for instance a pipe, by means of pressurized fluids and profiling tools according to the present invention. Such FIG. 1 also shows a fluid-dynamics control unit (2) provided with means, not graphically shown, suitable for feeding a first injector (6) and a second injector (9), better illustrated below, with fluids at different pressures. A pusher (3) is also shown suitable for pushing the metal tubular product to be machined. A vise (4) is suitable for clamping the pipe and a female mold (5), not graphically shown, suitable for determining the desired form of the pipe through the forming process is present in the external portions of the pipe to be formed. FIG. 1 also shows a first injector (6) provided with two radial channels ($\mathbf{6}^1$ and $\mathbf{6}^2$), not graphically shown. The figure also shows a second injector (9) in a position specular with respect to the first injector (6) provided with one radial channel ($\mathbf{9}^1$) and one gasket ($\mathbf{8}^1$), not graphically shown, or alternatively with two radial channels ($\mathbf{9}^1$ and $\mathbf{9}^2$) and two gaskets ($\mathbf{8}^1$ and $\mathbf{8}^2$), not graphically shown.

A battery (7) of profiling tools is located next to the first injector (6), FIG. 2 shows the first injector (6) with the two radial channels ($\mathbf{6}^1$ and $\mathbf{6}^2$) and two retractable gaskets ($\mathbf{8}^1$ and $\mathbf{8}^2$), self-centering during the expansion step. Such gaskets are represented during the expansion step. FIG. 2*b* shows the second injector (9) with the two radial channels ($\mathbf{9}^1$ and $\mathbf{9}^2$) and two retractable gaskets ($\mathbf{8}^1$ and $\mathbf{8}^2$), self-centering during the expansion step. Such gaskets are represented during the expansion step.

FIG. 3 shows a three-dimensional representation of a pipe formed in one and the same work cycle in continuous portions thereof by means of an injector (6) provided with two radial channels ($\mathbf{6}^1$ and $\mathbf{6}^2$) and two gaskets ($\mathbf{8}^1$ and $\mathbf{8}^2$). Said injector (6) is fed with fluids at the same pressure level. Note that two conventional injectors should be used to get such machining if using known machines.

FIG. 4 shows a three-dimensional graphical representation of a pipe formed, by using a first injector (6) provided with two radial channels ($\mathbf{6}^1$ and $\mathbf{6}^2$) and two gaskets ($\mathbf{8}^1$ and $\mathbf{8}^2$), and profiled in one and the same work cycle.

FIG. 5 shows a three-dimensional representation of a pipe formed in one and the same work cycle in non-continuous portions of said pipe by using an injector (6) provided with two radial channels ($\mathbf{6}^1$ and $\mathbf{6}^2$) and two gaskets ($\mathbf{8}^1$ and $\mathbf{8}^2$) and a second injector (9) provided with two radial channels ($\mathbf{9}^1$ and $\mathbf{9}^2$) and two gaskets ($\mathbf{8}^1$ and $\mathbf{8}^2$). Such injectors are fed with fluids at different pressures.

Figure 1:
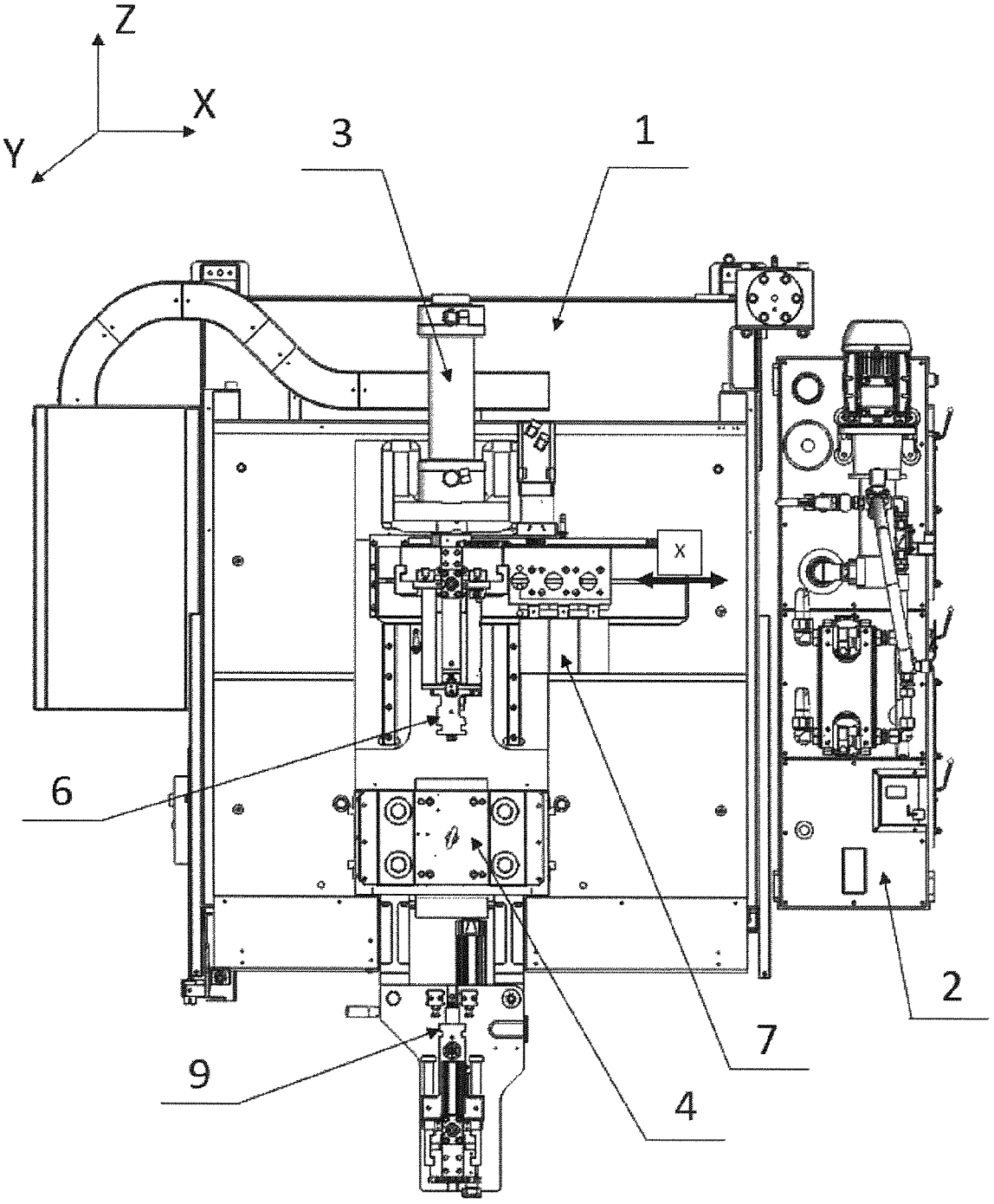
FIG. 1 shows a schematic representation of a machine according to the present invention.
Figure 2:
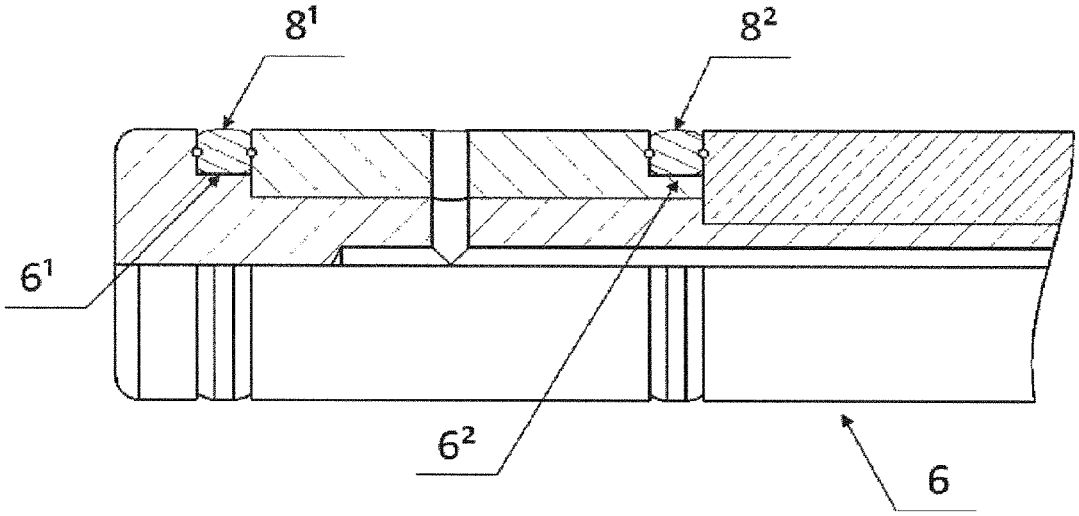
FIGS. 2 and 2*b* show a partial cross-sectional representation of an injector with two gaskets.
Figure 2B:
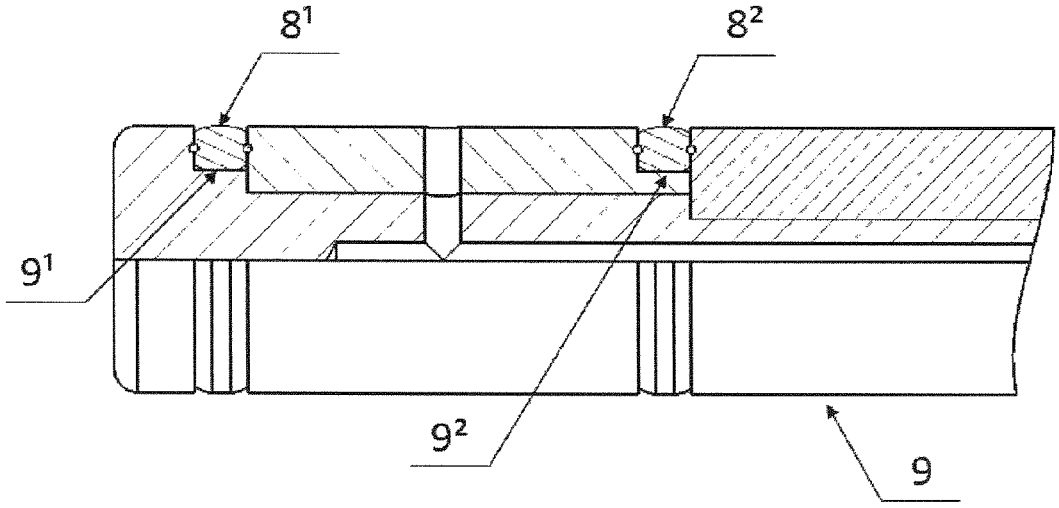
Figure 3:
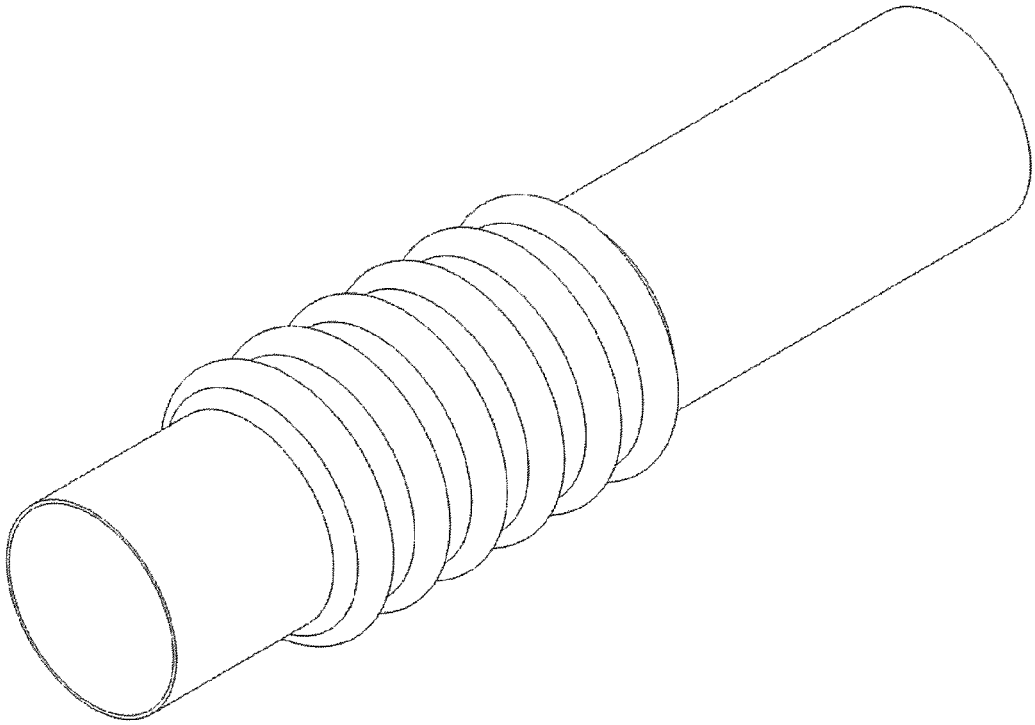
FIG. 3 shows a three-dimensional representation of a pipe formed by using an injector with two gaskets, the fluid being at one pressure level only.
Figure 4:
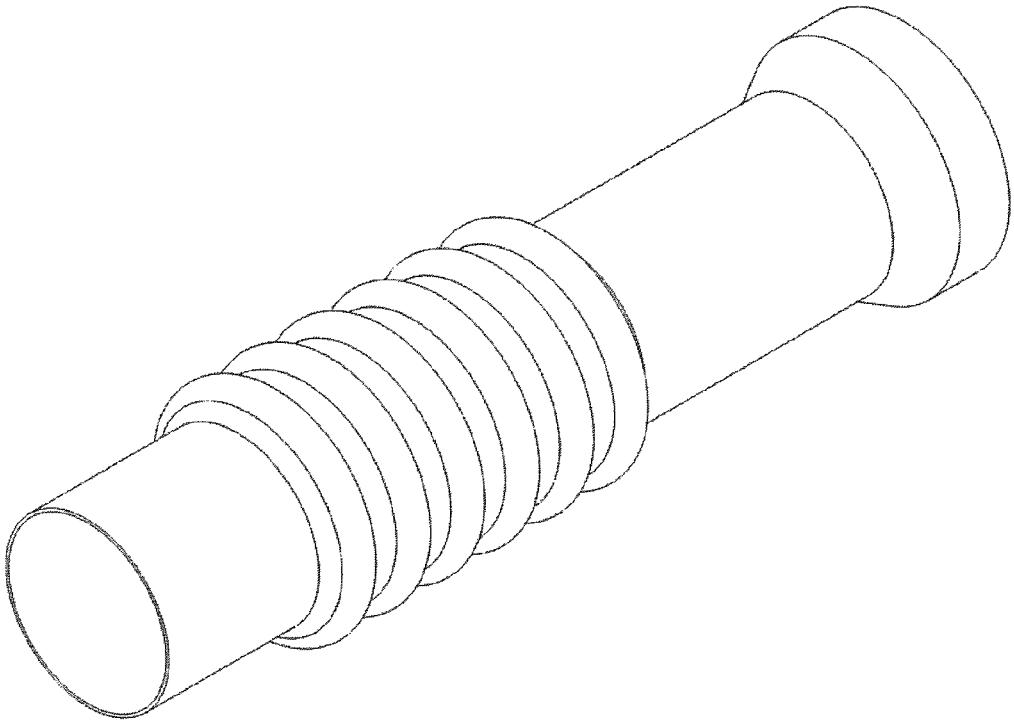
FIG. 4 shows a three-dimensional representation of a pipe formed by using an injector with two gaskets and profiled in one and the same work cycle.
Figure 5:
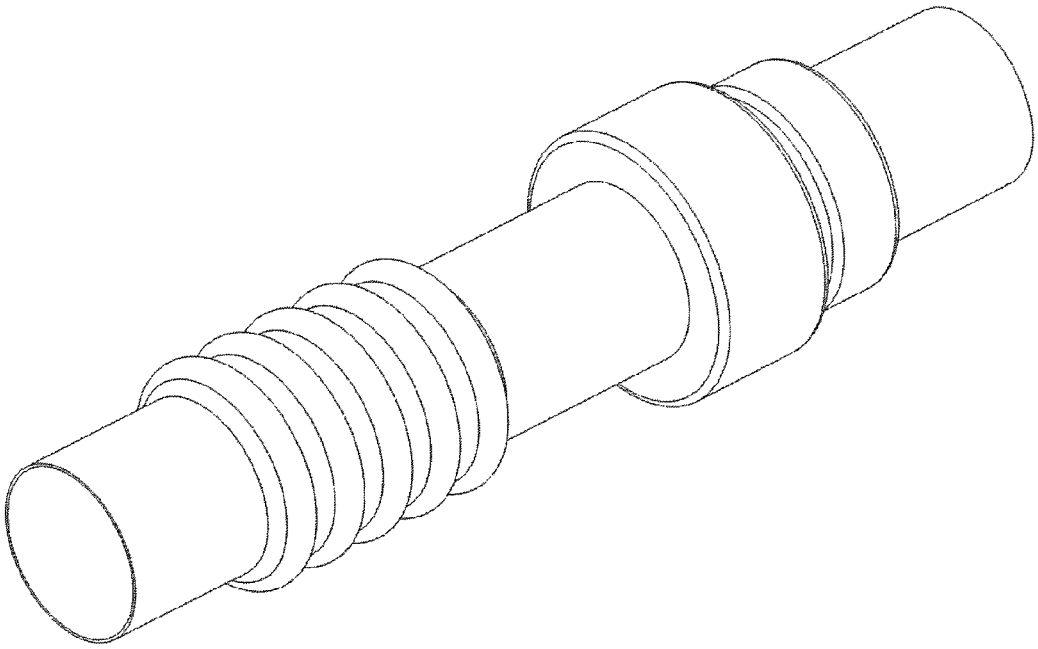
FIG. 5 shows a three-dimensional representation of a pipe formed in non-continuous portions thereof in one and the same work cycle by using two injectors with two gaskets, the fluid being at different pressures.

The invention claimed is:

1. A machine for forming and profiling a metal tubular product using pressurized fluids and profiling tools comprising:

means for feeding a pressurized liquid to the machine, a pusher configured and arranged for pushing the metal tubular product, a vise, a mold configured and arranged for determining a desired profile of the metal tubular product through a forming process, and at least a first injector and a second injector provided with at least one battery of profiling tools, wherein the first injector includes a first aperture for providing pressurized liquid received from the means for feeding to an interior of the tubular product and the second injector includes a second aperture for providing pressurized liquid received from the means for feeding to the interior of the tubular product, wherein the first injector is provided with two first radial channels and two first gaskets, wherein one of said first gaskets is seated within each of said first radial channels, and further wherein said first aperture is between said first radial channels, when considered along an axis of the first injector, and wherein the second injector is provided with one second radial channel only and one second gasket only, where the second gasket is seated within the second radial channel, and wherein the battery of profiling tools is placed next to at least one of the first and second injectors, and further wherein said at least one injector next to the battery is configured and arranged to move along an x axis or a z axis to thereby leave space for operation of the profiling tools when a forming step is completed according to a work cycle.

2. The machine for forming and profiling a metal tubular product, according to claim 1, wherein the means for feeding is configured and arranged for feeding each of said first and second injectors with fluids at different pressures.

3. A machine for forming and profiling a metal tubular product using pressurized fluids and profiling tools comprising:

means for feeding a pressurized liquid to the machine, a pusher configured and arranged for pushing the metal tubular product, a vise, a mold configured and arranged for determining a desired profile of the metal tubular product through a forming process, and at least a first injector and a second injector provided with at least one battery of profiling tools, wherein the first injector includes a first aperture for providing pressurized liquid received from the means for feeding to an interior of the tubular product and the second injector includes a second aperture for providing pressurized liquid received from the means for feeding to the interior of the tubular product, wherein the first injector is provided with two first radial channels and two first gaskets, wherein one of said first gaskets is seated within each of said first radial channels, and further wherein said first aperture is between said first radial channels, when considered along an axis of the first injector, and wherein the second injector is provided with two second radial channels and two second gaskets, where one of the second gaskets is seated within each of the second radial channels, and wherein the battery of profiling tools is placed next to at least one of the first and second injectors, and further wherein said at least one injector next to the battery is configured and arranged to move along an x axis or a z axis to thereby leave space for operation of the profiling tools when a forming step is completed according to a work cycle.

4. The machine for forming and profiling a metal tubular product, according to claim 3, wherein the means for feeding is configured and arranged for feeding each of said first and second injectors with fluids at different pressures.

5. The machine for forming and profiling a metal tubular product according to claim 3, wherein said second aperture is between said second radial channels, when considered along an axis of the second injector.

* * * * *